United States Patent [19]

Dahowski

[11] 3,950,907

[45] Apr. 20, 1976

[54] RADIUS MEANS FOR THE CORNERS OF SWIMMING POOLS

[75] Inventor: Donald E. Dahowski, York, Pa.

[73] Assignee: Fox Pools, Inc., York, Pa.

[22] Filed: Apr. 24, 1972

[21] Appl. No.: 246,569

Related U.S. Application Data

[63] Continuation-in-part of Ser. No. 101,876, Dec. 28, 1970, abandoned.

[52] U.S. Cl. ..... 52/287; 52/169 R

[51] Int. Cl.[2] ..... E02D 27/00; E04B 2/06

[58] Field of Search ..... 52/282, 287, 288, 482, 52/152, 169, 264, 364; 287/20.92 D

[56] References Cited

UNITED STATES PATENTS

| | | | |
|---|---|---|---|
| 245,162 | 8/1881 | Hallenbeck | 52/282 |
| 2,457,002 | 12/1948 | Spiro | 287/20.92 D |
| 2,641,029 | 6/1953 | Trimmer | 52/287 |
| 2,708,016 | 5/1955 | Penton | 52/396 |
| 2,728,957 | 1/1956 | Keller | 52/288 |
| 3,363,383 | 1/1968 | La Barge | 52/169 |
| 3,416,165 | 12/1968 | Pereira | 52/152 |
| 3,604,169 | 9/1971 | Smith | 52/288 |
| 3,673,751 | 7/1972 | Boassy | 52/169 |
| 3,707,061 | 12/1972 | Collette | 52/288 |
| 3,729,889 | 5/1973 | Baruzzini | 52/264 |

FOREIGN PATENTS OR APPLICATIONS

| | | | |
|---|---|---|---|
| 772,887 | 4/1957 | United Kingdom | 52/287 |
| 12,023 | 9/1887 | United Kingdom | 52/482 |
| 769,347 | 1/1967 | Canada | 52/288 |

*Primary Examiner*—Ernest R. Purser
*Assistant Examiner*—James L. Ridgill, Jr.
*Attorney, Agent, or Firm*—C. Hercus Just

[57] ABSTRACT

A radius member adapted to be connected to the corners of a swimming pool at the intersections of adjacent sidewalls, and having a flexible radius strip extending in a concave arc in said corners, the opposite edges of the radius strip engaging said sidewalls substantially tangentially so that a thin waterproof lining for the swimming pool may be disposed against said sidewalls and the arcuate inner surface provided by the radius strip and thereby minimize the possibility of damage to said lining at the corners of the pool. Several embodiments of means to connect the radius strip to the corners of the pool are included herein, one of these being of a relatively permanent nature and another being readily detachable from the pool.

9 Claims, 11 Drawing Figures

INVENTOR.
DONALD E. DAHOWSKI
BY
ATTORNEY

INVENTOR.
DONALD E. DAHOWSKI

BY

ATTORNEY

RADIUS MEANS FOR THE CORNERS OF SWIMMING POOLS

This application is a continuation-in-part of prior application, Ser. No. 101,876, filed Dec. 28, 1970, and now abandoned.

BACKGROUND OF THE INVENTION

Many in-ground, as well as above-the-ground types of swimming pools, presently are in use in which adjacent side and/or end walls are disposed at an angle, such as a right angle, to each other. The adjacent walls are substantially vertical and are connected together at a relatively sharp angle by various means. It is conventional when applying a waterproof liner sheet to the sidewalls and/or bottom of the pool to drape it over the inner surfaces of the sides and/or end walls by suspending it downwardly along the walls from the upper edges thereof. At the sharp corners, the liner sheet is disposed within the sharply angled corner and this not infrequently produces a tendency for the liner to crack, split or otherwise be damaged in the vicinity of said sharp corner. This is due particularly to the formation of an equally sharp angle directly in the liner sheet incident to it being pressed firmly against the wall surfaces at said corner by the water contained in the pool.

Some attempts have been made heretofore to correct the undesirable situation referred to above. One such attempt is illustrated in U.S. Pat. No. 3,256,532, to Lindsey et al, dated June 21, 1966. In this patent, rather simple type 45° fillets or fillet strips or members extend between the adjacent ends of a pair of sidewalls and/or a sidewall and an end wall for disposition of the liner material thereagainst. However, the fillet is rigid and the operative surface thereof is flat, whereby an angle of substantially 135° is formed in the liner sheet at opposite edges of the fillet member. Such angle is also subject to eventual cracking or splitting. The rigidity of the fillet also prevents any conformity thereof to any uneven surface areas in the pool walls. Therefore, it is the principal purpose of the invention to minimize and prevent any such tendency for the liner sheet to crack, split, or otherwise be damaged by providing special radius means in the corners of a swimming pool, details of which are set forth below.

Various types of fillet structure currently are in use which are of an exterior nature, such as to provide exterior corners of furniture and the like but these do not appreciate or solve the problems with which the present invention is concerned.

SUMMARY OF THE INVENTION

It is the principal object of the present invention to provide fillet-type radius means adapted to be disposed in the corners, such as right-angled corners, of a swimming pool of the type which utilizes thin, flexible lining material against the walls of the pool, said fillet means having a flexible radius strip which is of such nature that it is self-aligning by its nature to assume an arcuate configuration extending through an arc of substantially 90° and the opposite edges of the fillet member preferably being automatically urged into close, substantially tangential contact with the planes of both of the side and/or end walls of a swimming pool in which the fillet member is used.

It is another object of the invention to provide said radius means with a strip of material having limited flexibility whereby, incident to affixing the radius means to each corner of the swimming pool, said strip becomes spring-loaded with respect to the side and/or end walls of the pool to dispose the edges of the strip of said radius member in very close tangential engagement with said walls as aforesaid, such engagement being achieved automatically incident to connecting the radius means to the corners of a pool.

It is a further object of the invention to provide said radius strip of each fillet-type radius means with a member such as a web which, in use, extends rearwardly from the convex surface of said strip, when installed in a pool, a suitable and relatively precise distance to cause said radius strip to be curved arcuately in concave manner on the pool side of said strip, said web terminating in connecting means adapted to be clamped by the structure which normally connects the ends of the wall and/or end panels to each other at the corners of a pool and thereby hold said web in position to maintain said radius strip in said desired arcuate shape.

It is still another object of the invention, ancillary to the foregoing object, to provide attaching means in the form of a pair of angularly related ribs which preferably are integral with the web of the radius member and which, in turn, preferably is also integral with said radius strip, the angularly related ribs of the attaching means being adapted to be clamped respectively between the flanges of an angle bar and terminal end flanges of the wall panels which normally are clamped to the flanges of said angle bar, whereby the ribs of said attaching means are tightly clamped between the coengageable surfaces of said angle bar and terminal end flanges of the wall panels and no additional provision for clamping means is necessary under normal circumstances, in accordance with one embodiment of the invention.

It is another object of the invention to provide another embodiment of radius means in which the attaching means thereon have flanges arranged to be directly attached to adjacent end flanges of the walls of a pool at the corners thereof and thereby additionally serve the function of a conventional angle bar of the type normally used to connect said wall flanges at the corners of a pool.

It is still another object of the invention to provide radius means having attaching means which are detachable from the radius strip of said means, whereby said radius strip may be readily removed from the corner of a pool without disturbing part of the attaching means which remains connected to the corner of the walls of a pool.

Ancillary to the foregoing object, it is a further object to provide separable interlocking means respectively on the radius sttrip attaching means which are longitudinally slidable relative to each other to effect connection and disconnection thereof.

It is still a further object of the invention to form said radius means preferably from homogeneous material, either synthetic resin, which is of a semi-rigid but flexible nature, or metal of a suitable alloy and at least the radius strip of said radius means being sufficiently thin that, under the circumstances of the radius member being clamped into operative position in the corner of a swimming pool, either kind of radius strip will have a smooth arcuate shape imparted automatically thereto which extends through an arc of substantially 90° and the opposite edges thereof are disposed closely and automatically into tangential engagement with the adjacent portions of the walls of a pool which define such corners thereof, whereby a continuously smooth surface is provided against which a thin flexible liner sheet of the pool is disposed, especially when under pressure from the water in the pool, and thereby minimize the possibility of damage occurring to the flexible liner sheet when so disposed against the walls of said pool.

Details of the foregoing objects and of the invention, as well as other objects thereof, are set forth in the following specification and illustrated in the accompanying drawing comprising a part thereof.

DESCRIPTION OF THE PREFERRED EMBODIMENTS

Figure 1:
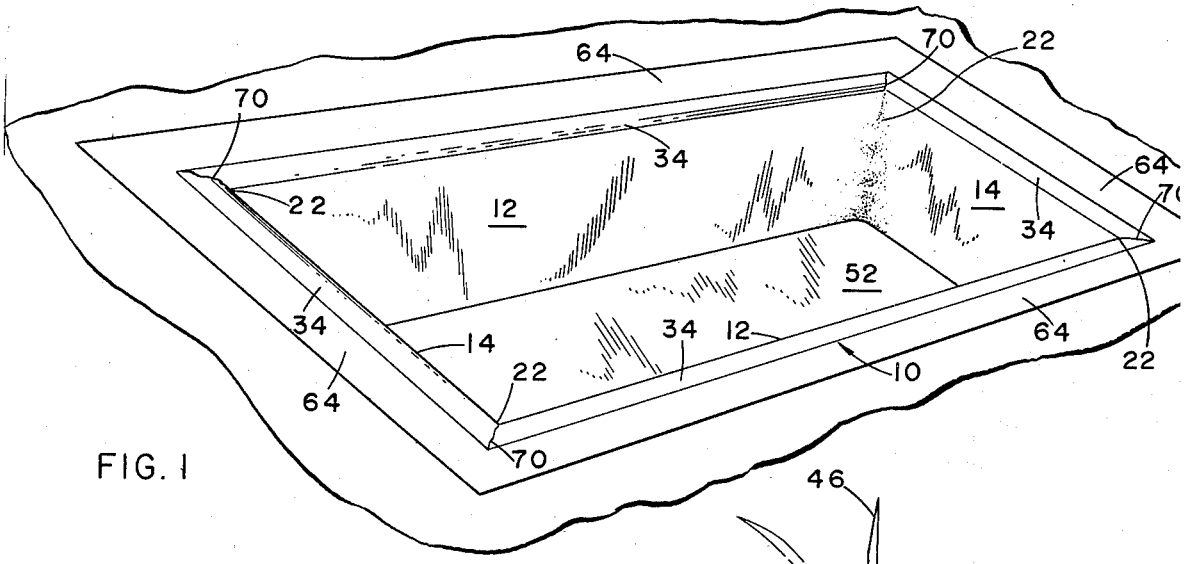
FIG. 1 is a perspective view of an exemplary swimming pool in which radius members embodying the principles of the invention are disposed in the corners thereof.

Referring to FIG. 1, an exemplary swimming pool 10 is shown which is of rectangular construction. It is to be understood that the present invention is applicable to many different geometrically shaped pools and especially those having one or more 90° corners therein, or some other angle reasonably comparable thereto, either smaller or greater, including angles as much as approximately 135°. As indicated above, the principal objective of the invention is to provide smoothly rounded or arcuate concave surfaces in what might be termed corners or angular joints in the wall structures of a swimming pool which occur at the junction of two wall and/or end surfaces.

Figure 2:
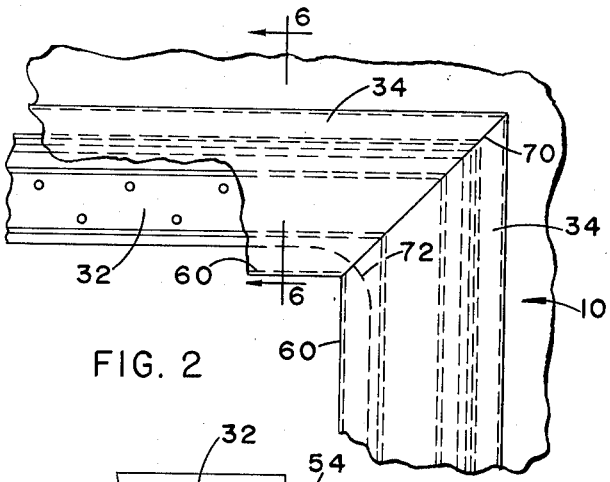
FIG. 2 is an enlarged, fragmentary top plan view of one corner of the pool shown in FIG. 1 and illustrating details of the curved configuration of a liner for said pool which is effected by the radius member comprising the present invention.

Particularly where a pool is provided with a waterproof liner of relatively thin synthetic material, such as a vinyl type of resin, it has been found that the portion of such liner disposed in a so-called sharp corner of pool walls tends to become creased and ultimately splits, thereby causing a leak through the liner. By providing a radius member of the type comprising the present invention in such corner structures, a smoothly rounded concave surface is provided which merges at the edges thereof tangentially with the adjacent portions of the sidewalls of the pool against which the opposite edges of the radius member abut or adjoin. Details of such structure are as follows:

It will be seen from FIGS. 1 and 2 that the exemplary pool comprises a pair of opposite sidewalls 12 and a pair of end walls 14. As seen by reference to FIGS. 3, 5 and 6 in particular, the sidewalls 12 and end walls 14 preferably are formed from sheet material such as sheet metal. Without restriction thereto, galvanized iron sheets of suitable gauge are highly appropriate for this purpose. Said sheets normally are mounted substantially vertically and, as will be seen from FIG. 6, they are connected to spaced vertical studs 16 or other suitable bracing members. The opposite ends of the sheets which form the walls 12 and 14 are provided with end flanges 18 and 20 which preferably extend perpendicularly rearwardly from the surfaces of the aforementioned sheets.

It will be understood that, intermediately of the ends of said sidewalls or end walls of the pool, the flanges of said sheets may be connected together by being abutted and secured by appropriate bolts or the like. However, at the corners 22 of the pool, where the sidewalls and end walls thereof are connected, it is preferred that an angle bar 24, which sometimes is referred to as an angle iron, be employed for connection of the angularly related sides or flanges thereof respectively to the end flanges 18 and 20 of the sheets which comprise the sidewalls and/or end walls of the pool.

Figure 3:
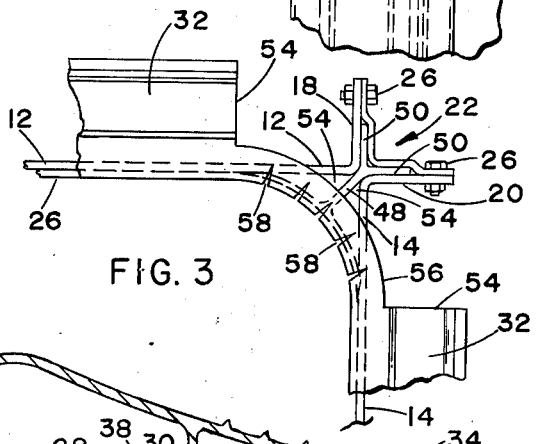
FIG. 3 is a fragmentary top plan view showing details of the corner construction shown in FIG. 2 and illustrating additional details over those shown in FIG. 2.
Figure 5:
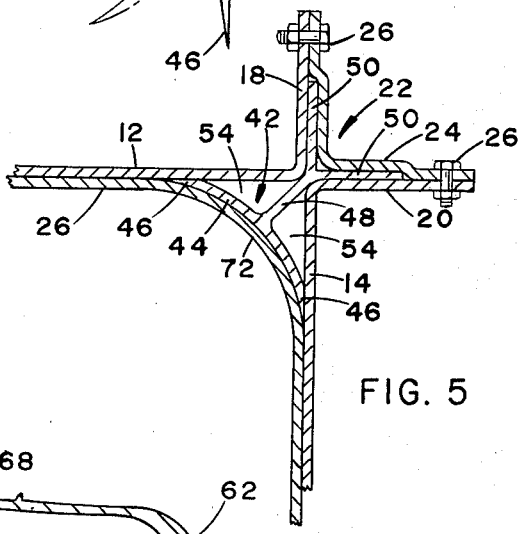
FIG. 5 is a fragmentary, horizontal sectional plan view of the corner structure shown in FIG. 3 but illustrated on a larger scale than employed in the latter figure so as to show details of the invention to a greater extent of clarity.
Figure 6:
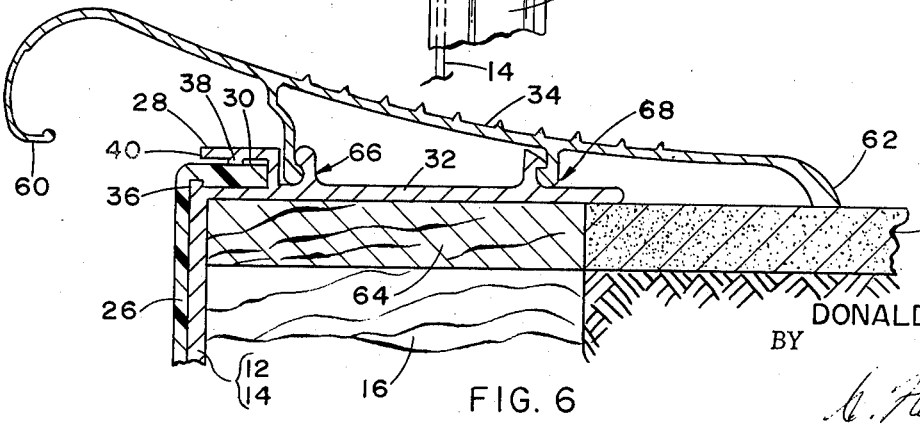
FIG. 6 is a fragmentary exemplary vertical sectional view of a portion of the sidewall of a swimming pool as seen on the line 6—6 of FIG. 2 and illustrating details of a coping structure shown in FIGS. 1 and 2.

Suitable axially aligned holes are formed in the end flanges 18 and 20 as well as in the side flanges of the angle bar 24 for the reception of connecting bolts 26, as shown particularly in FIGS. 3 and 5. In said figures, the side flanges of the angle bars are shown as having slight offsets therein intermediately of the edges thereof but said offsets are intended to be illustrative rather than restrictive and may be eliminated if desired.

In conventional pools employing sidewalls and end walls formed from metal sheets such as described above, it is normal to directly connect the relatively flat side flanges of the angle bar 24 directly to the end flanges 18 and 20 of the metal sheets 12 and 14, whereby a sharp, right-angled corner is formed against which the exemplary sheet type synthetic resin, waterproof liner 26 is disposed in flat relationship. The upper edge of the liner preferably is formed with or is fastened to a thickened bead 28, shown in exemplary manner in FIG. 6, for disposition within a channel 30, or other comparable supporting means, which is formed in one edge of a base member 32 to which an extruded type rigid coping 34 is connected by means to be described hereinafter. Base member 32 may be formed preferably from either suitable non-corrodible metal or a relatively stiff synthetic thermoplastic resin.

The channel 30, at the terminal edge of its lower portion, is provided with a short upstanding lip 36 which extends longitudinally for engagement by the offset portion of the thickened bead 28 on the upper edge of the liner 26. To further insure secure positioning of the thickened bead 28 within the channel 30, a short downwardly extending rib 38 is provided in the upper flange 40 of the channel member.

In accordance with the principal feature of the present invention, one embodiment of a fillet-type radius member 42 is shown which is provided with a radius strip 44 of substantially sheet-like material which preferably has limited flexibility. Said strip 44 also is of semi-rigid nature and of uniform thickness, except at the terminal edges, as clearly shown in FIG. 4, whereby the strip is sufficiently thin that it permits limited flexibility which is adequate to enable the strip to bend about its axis into an arc of substantially 90° extent, incident to being installed in the corner of a pool. Certain types of thermoplastic synthetic resin may be employed which are reasonably stiff but capable of permitting the strip 44 to be flexed into arcuate configuration as shown in phantom in FIG. 4 Certain formulations of acrylonitryl butadiene styrene, as well as polyvinyl chloride, are very suitable.

The purpose of this strip is to form automatically, by self-conformity, a smoothly rounded concave corner surface at the junction of two of the wall members such, for example, as sidewall 12 and end wall 14 shown in FIG. 5 incident to the radius members being installed at the corners of the pool. Preferably, the opposite edges of the strip 44 are tapered or feathered to a sharp angle defining the opposite surfaces thereof, whereby, when the radius member is installed in a corner of the pool, such as shown in FIG. 5, the edge portions 46 are substantially smoothly tangential with the outer surfaces of such wall members. Preferably, when flexed, the radius strip 44 subtends an arc of approximately 90°, as clearly shown in FIGS. 4 and 5. Said edges, in effect, are spring loaded to conform closely to the wall surfaces due to the nature of the material. Thus, this eliminates the possibility of any appreciable gap or crevice occurring between any of the fillet-type radius inserts 42 and the pool wall surfaces 12 and 14, such as is possible to occur when using a rigid, pre-formed fillet member.

To secure the radius member 42 in operative position in the corner of a pool and also produce and retain the arcuate concave shape of the radius strip 44 thereof, said member is provided with attaching means comprising a web 48 which extends longitudinally of and is integral with the strip 44, as well as being substantially perpendicular radial thereto substantially midway between the edges thereof. The edge of the web 48 which is opposite the one that is connected to the strip 44 is provided with securing means comprising a pair of similar ribs 50. In the preferred construction thereof, the ribs 50 are disposed substantially at 90° to each other and also respectively subtend equal angles relative to the web 48.

When the walls which form the sides and ends of the pool 10 are to be connected together, a suitable length of the radius member 42 is selected so as to extend preferably between the bottom 52 of the pool and the upper edges of the walls thereof. When said member is formed from synthetic resin, it is readily cut by a conventional carpenter's saw.

If desired, the member 42 also may be formed, such as by extrusion, from a suitable aluminum alloy or the like. Under such circumstances, the thickness of the radius strip 44 is such that it is resilient and may be flexed readily, as shown in phantom in FIG. 4, without requiring the use of abnormal force.

Such strip is suitably maintained initially in such flexed condition by any suitable means until the ribs 50 are secured between the end flanges 18 and 20 of the wall members and the opposite flanges of the angle bar 29. Said flanges have axially aligned holes therein to receive bolts 26. Upon tightening the bolts 26, the clamping pressure exerted by the aforementioned flanges respectively upon the opposite surfaces of the ribs 50 is fully adequate to retain the radius member 42 in operative position with the radius strip 44 thereof smoothly curved to subtend an arc of approximately 90° extent and thereby secure the tapered outer edges 46 of the strip 44 in smooth and close tangential engagement with the outer surfaces of the wall members 12 and 14, as shown in exemplary manner in FIG. 5.

The length of web 48 relative to the length of radius strip 44 is such that when the ribs 50 are fully positioned in clamping position, the strip 44 will automatically be drawn into a smooth arc subtending an angle of about 90°.

From the structure shown in FIG. 5, it will be seen that there are spaces 54 between the rearward surfaces of the strip 44 and the outer surfaces of the wall members 12 and 14 when the radius member 42 is installed in operative position. In order that these will not form a potential space within which water from the pool may splash, by referring to FIG. 3, it will be seen that the base member 32 to which the coping 34 is connected may have a section cut therefrom along the transverse lines 54 and along a longitudinal line 56, as shown in FIG. 3 in a curved configuration. Further, a number of angular darts or notches 58 may be formed in the outer edge of the base member 32, including the channel portion 30 thereof, in order to enable the base member 32 to be curved in the manner shown in FIG. 3 and thereby at least partially, or preferably entirely, cover the upper ends of the spaces 54.

As shown in FIG. 3, said spaces are not completely covered, but it can readily be visualized that if the longitudinal severance line 56 is selected so as to be closer to the median line of the base member 32, a width of the remaining structure can be provided which is adequate to completely cover the upper ends of the spaces 54, if desired. The only requisite is that the darts 58 be made long enough and occur at such intervals that a smoothly curved outer edge of the channel portion 30 is provided on the base member 32, especially for purposes of receiving the thickened attaching bead 28 along the upper edge of the liner 26.

As indicated above, the base member 32 primarily is for purposes of forming a supporting and locking or latching means for the coping sections 34. The coping sections 34 preferably extend from the innermost edges 60, which preferably overhang the pool, to the outermost edges 62 thereof, which preferably abut a deck member 64 or the like. The deck member 64 may be formed from any suitable material and the upper surface preferably is on the same plane as the upper surface of the longitudinally extending header member 64 to which the base member 32 is affixed. Said header also extends horizontally between the upper ends of the supporting studs 16 to which said header member is connected by spikes or the like.

Suitable snap-acting coengaging means 66 and 68 are provided respectively on the base member 32 and on suitable projections extending downwardly from the inner surface of the coping 34. It will be understood that the coping is provided in appropriate lengths such as of the order of 5, 6, 7, 8 or 10 feet. Adjacent sections abut each other at the ends thereof and, at the corners of the pool, the adjacent ends of the coping sections 34 are cut on an angle to form a miter joint 70, as best shown in FIGS. 1 and 2.

From FIG. 2, it readily will be seen that the width of the coping 34 and especially the extent of the innermost edges 60 thereof are such that, at the miter joint 70, such innermost edges 60 of the coping overhang the arcuate portions 72 of the liner at the corner of the swimming pool, whereby the upper ends of the corner structures and especially the spaces 54 are even more adequately protected so as to present an aesthetically pleasing appearance.

Figure 7:
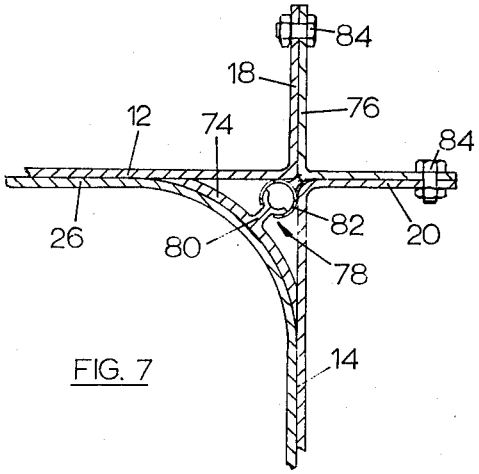
FIG. 7 is a transverse sectional view of a fragmentary corner of a swimming pool in which another embodiment of radius member is included in the corner structure.

In addition to the embodiment of fillet-type radius member or means 42, such as illustrated in particular in FIGS. 2–5, other embodiments of radius means are provided by the present invention, these being illustrated in FIGS. 7–11. In general, the additional embodiments of the radius means in FIGS. 7–11 differ from those shown in FIGS. 2–5 by having the radius strip per se detachably connected to securing means therefor by a pair of complementary interengaging members extending longitudinally respectively along said radius strip and securing means and slidably movable longitudinally relative to each other to effect connection and disconnection of said radius strip and securing means to and from each other. Details of these additional embodiments of radius means are as follows:

For simplicity, these additional embodiments of radius means are shown in fragmentary edge or top plan views of corners of a swimming pool. Referring to FIG. 7, it will be seen that the sidewall 12 of the pool has an end flange 18 extending perpendicularly thereto and the end wall 14 of the pool has an end flange 20 extending perpendicularly thereto, as in the embodiments shown in FIGS. 2–5. Radius means in FIG. 7, however, has a radius strip 74, which, in general shape and composition, is similar to the radius 44 of the preceding embodiment. The strip 74 is detachably connected to securing means 76 by composite connecting means 78 which comprises a pair of complementary interengaging members 80 and 82 which are elongated and are coextensive in length with the radius strip 74 and securing means 76 with which they respectively and preferably are integral.

The securing means 76 may be formed either from synthetic resin or metal of the types described with respect to radius member 42 of the preceding embodiment. It will be seen in the arrangement shown in FIG. 7 that the flanges 18 and 20 are provided with a series of holes which are axially aligned with similar holes in the angularly disposed flanges of the securing means 76 for the reception of connecting bolts 84 therethrough. The member 82 of the connecting means 78 which is integral with the securing means 76 comprises a somewhat tubular enclosing member which is longitudinally slotted for purposes of receiving the transversely extending, longitudinal extremity on the other member 80 of the connecting means 78, whereby the members 80 and 82 may be longitudinally and slidably moved relative to each other, but separating movement in a radial direction is not possible. It also will be seen that the direct connection of the flanges of the securing means 76 to the flanges 18 and 20 of the walls 12 and 14 of the swimming pool eliminates the need for an angle bar 24 as in the embodiment illustrated in FIGS. 3 and 5. Under such circumstances, the preferred material for the securing means 76 and its member 82 is suitable metal which may be extruded to form the element.

The principal advantage of the detachably connectable radius strip 74 and securing means 76 is that after the pool is installed, if there is any need to replace the radius strip 74, the same readily may be slidably removed from engagement with the securing means 76 and another radius strip 74 may be inserted in operative position without requiring any appreciable disconnection of the corner structure of the pool and, in particular, not requiring the removal of securing means 76 from the flanges 18 and 20 of the walls of the pool. In addition, the junction between the member 82 and securing means 76 forms a pair of similar grooves in opposition to each other within which the corners which form the junction of walls 12 and 14 with their flanges 18 and 20 may be positioned during installation especially of the corner connections of the walls of the pool. Following the application of the connecting bolts 84 to secure the flanges 18 and 20 to the corresponding flanges of the securing means 76, the radius strip 74 then may be arcuately flexed from the full line position thereof shown in FIG. 10, for example, to the phantom position thereof, and the transversely extending, longitudinal terminal means 86 on member 80 of the radius strip may be slidably moved into the slotted enclosing member 82 to secure the radius strip 64 in operative, arcuate position within the corner of the pool defined by the walls 12 and 14.

Figure 8:
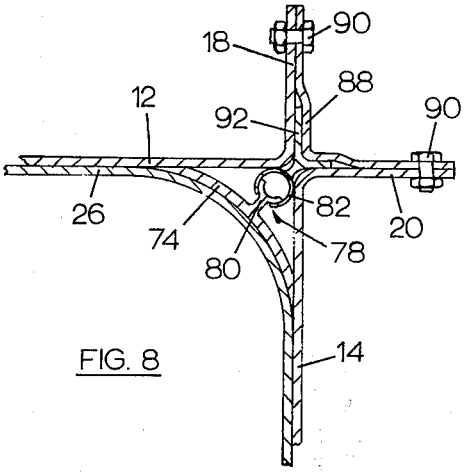
FIGS. 8 and 9 are views similar to FIG. 7, but in which still further embodiments of radius members and detachable attaching means therefor are illustrated.

A slightly modified version of the embodiment of radius means shown in FIG. 7 is illustrated in FIG. 8 and comprises a further embodiment in which an angle bar 88, which may be similar to the angle bar 24 of the embodiment shown in FIGS. 3 and 5, is connected by bolts 90 to the flanges 18 and 20 of the walls 12 and 14. In this embodiment, a modified version of the securing means 76 of the embodiment shown in FIG. 7 is provided which is identified as securing means 92. The securing means 92 differs from securing means 76 of the arrangement in FIG. 7 by the flanges thereof being shorter in order to be readily clamped between the flanges 18 and 20 of the walls and the angularly related flanges of the angle bar 88. Otherwise the embodiment shown in FIG. 8 is similar to that shown in FIG. 7 and includes the radius strip 72, connecting means 78 comprising the interengaging members 80 and 82, and the adaptability of the radius strip 74 to be slidably separated from the modified securing means 92 without requiring disconnection of the corner structure of the swimming pool. The radius strip 74 is shown in end view in its unflexed shape in full lines in FIG. 10 and in its flexed shape in phantom, the latter shape being the operable condition thereof, as is shown FIGS. 7 and 8.

Figure 9:
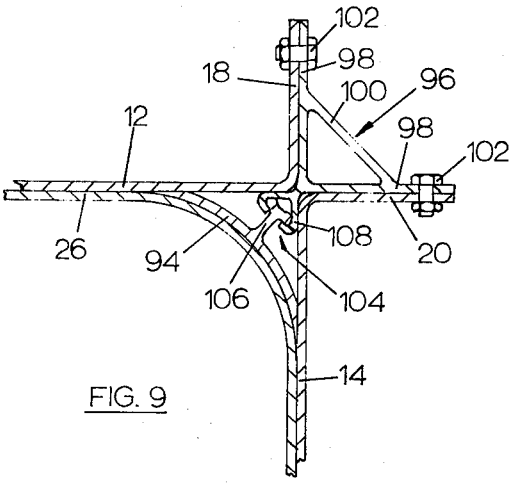
Figure 11:
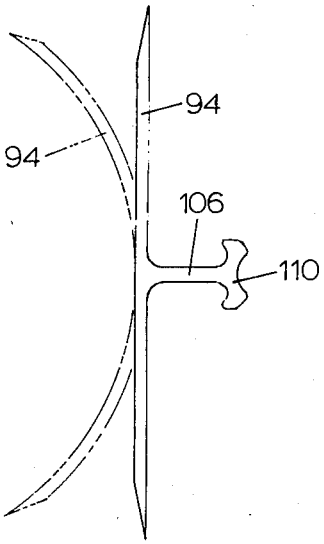
FIGS. 10 and 11 are end views of the radius members per se respectively shown in the arrangements of pool corners illustrated in FIGS. 8 and 9, the normal, uninstalled shape of said members being shown in full lines and the installed, arcuate shape of said members being shown in phantom.

Referring to FIGS. 9 and 11, a still further embodiment of corner construction of a swimming pool is illustrated, which embodies the principles of the present invention and comprises the walls 12 and 14 which are fragmentarily illustrated and the perpendicular end flanges 18 and 20 thereon. A radius strip 94 is included which, per se, may be formed from the same material as that described above with respect to the radius strip 44 of the embodiment shown in FIGS. 3–5, and also the radius strip 74 shown in the embodiment of FIGS. 7 and 8.

A slightly different form of securing means 96 is employed in the embodiment shown in FIG. 9, however, the same having a pair of angularly related flanges 98, between which a bracing web 100 extends and is integrally connected thereto. It will be understood that securing means 96 is preferably equal in length in a vertical direction to the flanges 18 and 20 of the walls of the pool and a series of axially aligned holes are provided in the flanges 18 and 20, as well as in the flanges 98 of securing means 96 for the reception of clamping bolts 102 therethrough.

The radius strip 94 is connected to the securing means 96 by connecting means 104, which comprise complementary, slidably connectable, interengaging members 106 and 108. Of these, the member 108 is the enclosing member of said pair and is longitudinally slotted for the reception of the web portion of member 106 which terminates in a T-shaped head 110 which extends longitudinally along the member 106 and is complementary to certain inner surfaces of the enclosing member 108 so as to permit relative longitudinal movement between the members, but also prevent separation thereof in a radial direction, as in regard to the embodiments shown respectively in FIGS. 7 and 8.

Referring to FIG. 11, it will be seen that, in full lines, the radius strip 94 is shown in its uninstalled shape, while in phantom, the same is shown in its arcuate, installed shape, as can be appreciated from FIG. 9.

Figure 4:
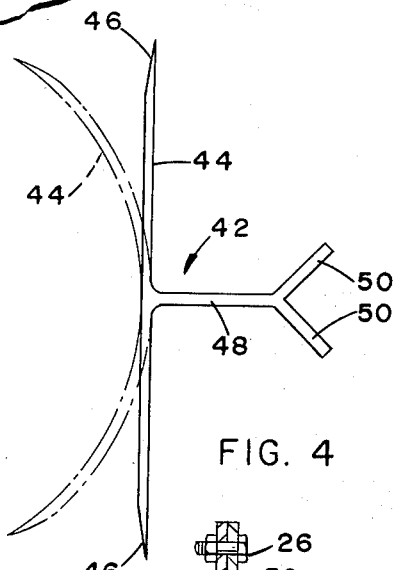
FIG. 4 is an end view of a radius member per se embodying the principles of the present invention, the same being shown in initial position in full lines and the radius-subtending strip thereof being illustrated in phantom in arcuate operative position.
Figure 10:
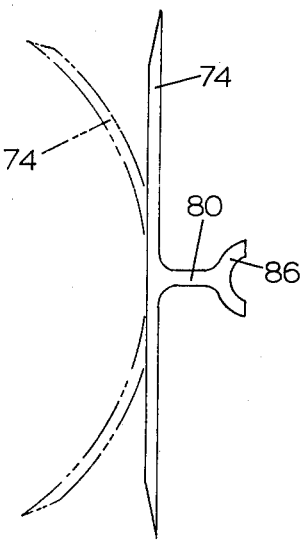

In regard to the embodiments of radius strips shown respectively in FIGS. 10 and 11, it will be seen that the opposite edges thereof are sharply tapered, similarly to the tapered opposite edges 46 of the radius strip 44 shown in FIGS. 4 and 5. The purpose of such taper is the same in all instances, namely, to provide a very smooth tangential merging of said edges of the radius strips relative to the flat walls 12 and 14 of the pool in order that the flexible, thin synthetic resin liner 26 may assume a smooth, arcuate configuration at the corners of the pool and thereby minimize the possibility of damage to the liner.

From the foregoing, it will be seen that the present invention provides smoothly curved concave surfaces at the corners of a swimming pool which are formed by the self-aligning radius strips of the various embodiments which comprise the principal feature of the present invention. The same may be formed so as to be resilient from suitable synthetic resin, or non-corrodible metal of suitable thickness. The nature of either type of material is such that incident to the radius member being installed in operative position in the corners of a swimming pool wall structure, said radius of the several embodiments readily may be flexed into an arcuate configuration terminating at edges which are spring loaded into tangential engagement with the planes of the adjacent wall surfaces. Thus, when the sheet-like lining material for the swimming pool is extended against said smoothly curved corner surfaces, as well as along the wall surfaces which meet at said corners, no crevices or corners will be formed. Therefore, the possibility of creases and cracks occurring, such as those which have heretofore resulted from the lining being disposed in sharp, angularly related corner surfaces provided in conventional swimming pools, is substantially eliminated by the use of the relatively simple means comprising the invention that can be manufactured at low cost and is of a durable nature so as to have long life. Further the aesthetic appearance of the pool is improved when using such radius members in addition to enhancing the life of the lining material.

While the invention has been described and illustrated in its several preferred embodiments, it should be understood that the invention is not to be limited to the precise details herein illustrated and described since the same may be carried out in other ways falling within the scope of the invention as illustrated and described.

I claim:

1. Fillet-type radius for use in vertical angular corners of the walls of swimming pools comprising in combination, an initially substantially flat elongated radius strip of substantially uniform thickness and formed from reasonably stiff material to render said strip semi-rigid but of limited flexibility and sufficiently thin to permit said strip to be flexed about a vertical axis from said substantially flat condition substantially into a transversely smoothly curved configuration subtending an arc of approximately 90° to adapt the edges thereof for resilient spring loaded tangential engagement firmly against the surfaces of a pair of angularly related sidewalls of a swimming pool and extend arcuately between said walls when said strip is flexed and the flexed concave surface of said strip being outermost to provide a smoothly rounded concave corner surface adapted to be engaged by and support a flatly overlying waterproof liner sheet for said pool, and attaching means on said radius strip comprising an elongated web fixed along one edge thereof to and extending longitudinally along and projecting radially from midway between the edges of the surface of said strip which is convex when flexed and having securing means comprising flat ribs extending longitudinally along the opposite edge of said elongated web and adapted to be positively clamped to the ends of the sidewalls of a swimming pool at a corner thereof to affix said strip in operative position therewith and hold said strip flexed and concaved and the side edges thereof in firm and smooth resilient tangential engagement with said walls of said pool adjacent a corner thereof due to the inherent resilience of said strip.

2. The radius means according to claim 1 in which said flat ribs of said securing means comprise a pair of ribs extending from said opposite edge of said web and away from said radius strip at an angle of approximately 90° to each other and adapted to be clamped relative to flanges on end portions of the walls of a pool, said ribs also extending at substantially equal angles from said elongated web.

3. The radius means according to claim 1 in which said securing means is separably connected to said radius strip by connecting means extending longitudinally thereof and comprising a pair of complementary longitudinally interengaging members respectively formed on said securing means and elongated web and longitudinally slidable relative to each other to effect connection and disconnection of said radius member and securing means to and from each other by said relative longitudinal movement, whereby said securing means may be clamped fixedly to a corner of said pool and said radius member may be disconnected from said securing means by moving the same longitudinally relative to said securing means while the securing means remains connected to the walls of said pool.

4. The radius means according to claim 3 in which said pair of interengaging members respectively comprise an elongated enclosing member having a slot extending longitudinally thereof and another elongated member provided with an elongated element having an enlarged terminal longitudinally extending end portion formed thereon for slidable interlocking disposition within said slotted enclosing member and said elongated element extending through the slot of said enclosing member in a manner to prevent withdrawal thereof in a transverse direction from said enclosing member.

5. The radius means according to claim 4 in which said slotted enclosing member of said pair of interengaging members is substantially tubular and said enlarged elongated terminal end on said other member of said pair is substantially complementary to the interior of said slotted tubular member.

6. The radius means according to claim 4 in which said enlarged elongated terminal end portion on said another elongated member is substantially T-shaped in cross-section and said elongated enclosing member is substantially complementary in cross-section thereto.

7. A swimming pool comprising a plurality of wall panels having connecting flanges at the ends thereof extending substantially perpendicularly to the planes of said panels, a 90° angle bar connected to said connecting flanges at adjacent ends of each pair of panels forming a corner of said pool, said flanges and angle bars having axially aligned holes therein, and connecting bolt means extending through said holes, in combination with fillet-type radius members connected to each corner of said pool and each radius member comprising an initially flat semi-rigid flexible radius strip of substantially uniform thickness and formed of inherently resilient material flexed into a concave arc of substantially 90° between said walls of said pool and thereby render the edges of said strip spring loaded to firmly engage said walls tangentially with resilience to receive a flexible pool liner positioned flatly against said wall panels and in smoothly curved engagement with said concaved surface of said radius strip, and attaching means connected to the convex surface of said radius strip and comprising a pair of ribs extending away from said radius strip and angularly to each other longitudinally of said strip, said ribs being clamped between said flanges on said walls of said pool and the sides of said angle bars to secure said radius members to said corners of said pool and maintain said radius strips thereon in concavely curved position and the edges of said strips tangentially engaging the walls of said pool closely and firmly due to the resilience of said radius strip.

8. The swimming pool according to claim 7 in which the opposite edges of said radius strip of each of said members are tapered at a sharp angle to the planes of said radius strips to provide a minimum offset at the engagement of said edges with the walls of said pool.

9. The swimming pool according to claim 7 in which said radius members extend substantially between the upper and lower edges of the walls of said pool.

* * * * *